United States Patent [19]

Benzon

[11] 4,072,539

[45] Feb. 7, 1978

[54] METHOD OF CLEANING RAW ORE

[76] Inventor: William Benzon, 613 Bittersweet Road, Center Valley, Pa. 18034

[21] Appl. No.: 743,553

[22] Filed: Nov. 22, 1976

[51] Int. Cl.[2] ..... B08B 7/04; F26B 1/00; F26B 5/04

[52] U.S. Cl. ..... 134/25 R; 34/13; 34/17; 34/20; 134/30; 209/10

[58] Field of Search ..... 134/25 R, 30, 37; 34/8, 34/10, 13, 17, 20; 209/10, 11, 238

[56] References Cited

U.S. PATENT DOCUMENTS

| | | | |
|---|---|---|---|
| 1,880,273 | 10/1932 | Pardee et al. | 209/11 X |
| 1,905,945 | 4/1933 | Machen | 209/11 X |
| 2,956,347 | 10/1960 | Gordon | 34/10 |
| 3,056,212 | 10/1962 | Jamison | 34/10 |
| 3,092,471 | 6/1963 | Stromeyer | 34/20 X |
| 3,579,442 | 5/1971 | Gerwig | 209/10 X |

*Primary Examiner*—Richard V. Fisher
*Attorney, Agent, or Firm*—Seidel, Gonda & Goldhammer

[57] ABSTRACT

A method of cleaning a raw ore product such as coal is disclosed wherein the ore product temperature is increased up to about 200°-212° F. before water is separated therefrom whereby the moisture content of the cleaned product is controlled. The ore product is passed through a bath of hot water, then surface water is removed before the ore product is moved through an evaporative cooler in a downward direction while being subjected to air at ambient temperature and at an air capacity of between 10,000 and 15,000 cubic feet per ton of ore product.

7 Claims, 2 Drawing Figures

METHOD OF CLEANING RAW ORE

BACKGROUND

Heretofore, a raw ore product such as coal has been cleaned by way of a method which includes rinsing and screening, removing surface water in a centrifuge or the like while the ore product is at ambient temperature, and then drying the ore product with a thermal dryer. A thermal dryer operates with air heated to 500°-1200° F. with an air flow per ton of coal being about 300,000-700,000 cubic feet. This high temperature high flow rate fluidizes dust and renders it bone dry whereby the high flow rate creates a pollution problem so that the outlet of the dryer requires a dust collector and a smokestack. The higher temperatures of the air in the thermal dryer are a potential hazard in view of the fact that many explosions are based on ignition of coal dust.

The method of the present invention overcomes the above disadvantages of the prior art as well as other disadvantages such as high initial cost, greater efficiency and/or uniformity of moisture content, lower operating costs, etc.

DISCLOSURE

The method of the present invention contemplates dividing the raw ore product into two streams as a result of a screening process. The larger sized ore product which does not pass through the screen is heated by conveying the ore product through a bath of hot water. Then, surface water is removed from the ore product. Then the ore product is dried to the desired moisture content by use of low volume, low velocity air at ambient temperature in an evaporative cooler.

The smaller sized ore product which passed through the stream is pumped as a slurry to a filter wherein the slurry is divided into two flow paths. One flow path is provided with a flotation cell for removing tailings and then joins the other flow path. Then the combined flow paths are heated by steam. Therafter, the steam heated ore product is dewatered (i.e., dried) by a vacuum filter to the desired moisture content.

It is an object of the present invention to provide a method of cleaning a raw ore product such as coal which is more efficient, avoids pollution problems, is less expensive to install and less expensive to operate.

Other advantages will appear hereinafter.

For the purpose of illustrating the invention, there is shown in the drawings a form which is presently preferred; it being understood, however, that this invention is not limited to the precise arrangements and instrumentalities shown.

Figure 1:
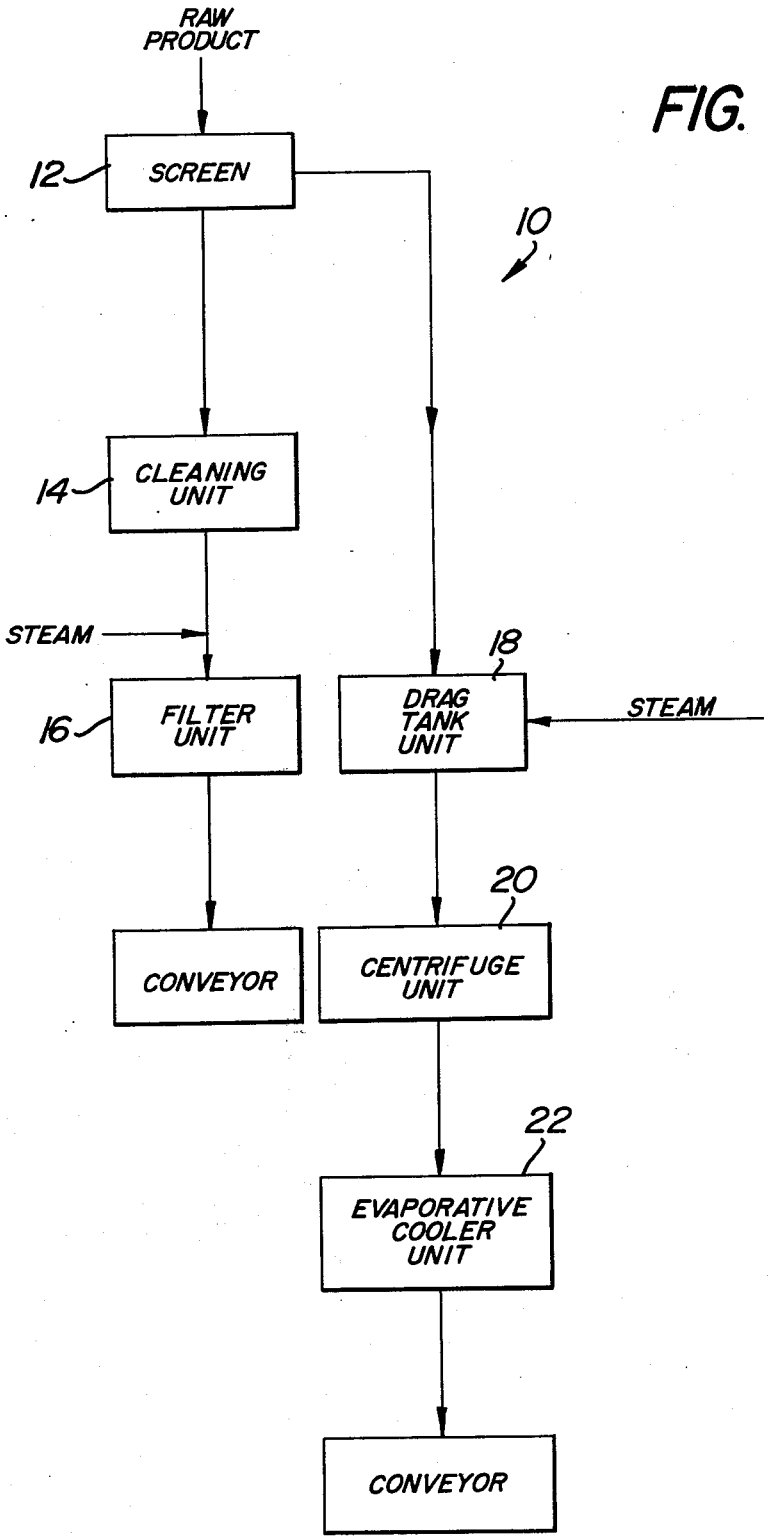
FIG. 1 is a block diagram of the method of the present invention.
Figure 2:
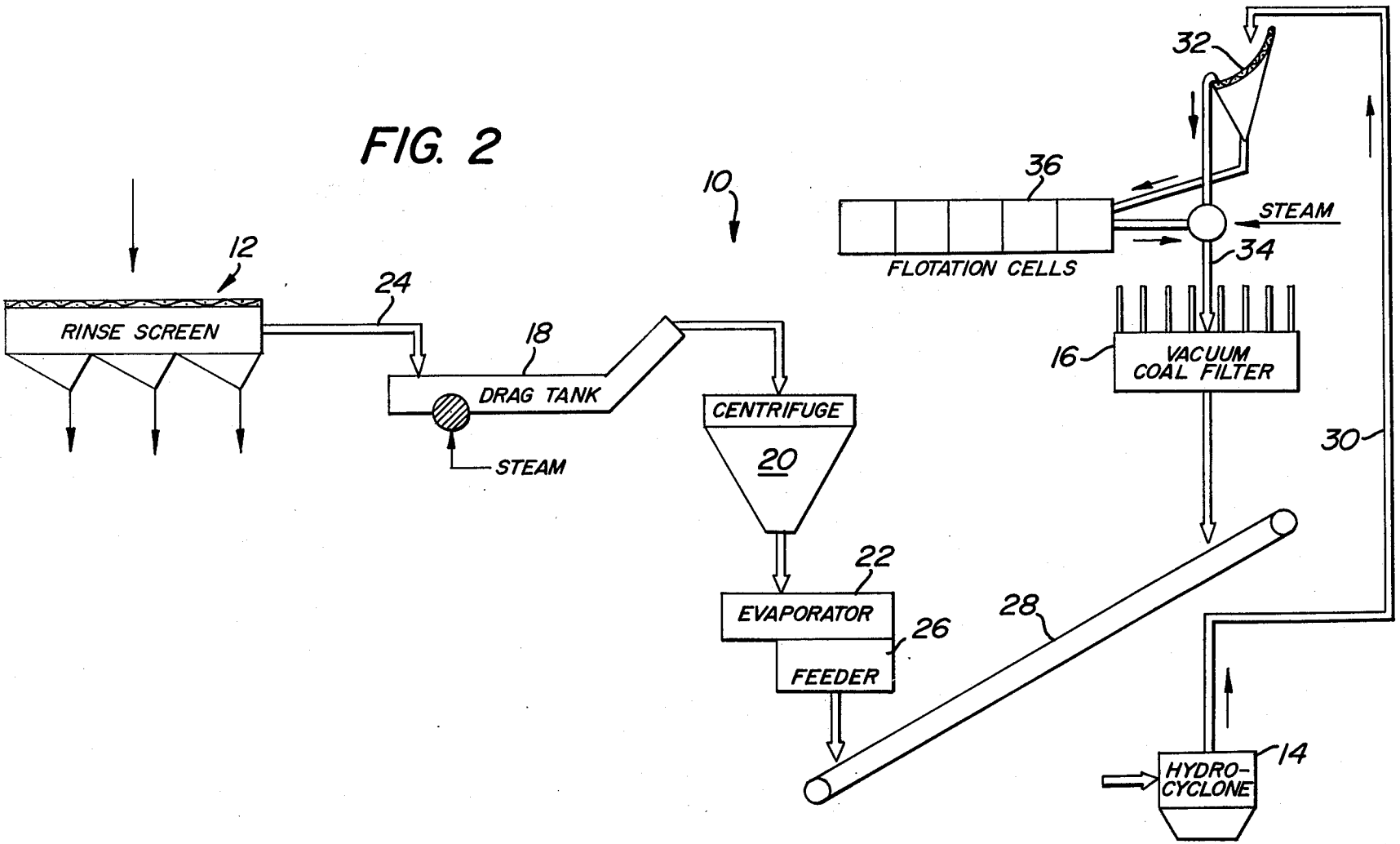
FIG. 2 is a diagrammatic illustration of the components of the block diagram.

Referring to the drawing in detail, wherein like numerals indicate like elements, there is illustrated in the drawings a system 10 in accordance with the present invention for cleaning raw ore products such as coal.

In the system 10, the raw ore product is conveyed to a rinse screen. The preferred screen size is 28 mesh. Those portions of the ore product which are smaller than 28 mesh will pass therethrough and will be treated separately as will be described hereinafter. The ore products which do not pass through the screen 12 have a size greater than 28 mesh and at this point will have a moisture content of about 15%. The ore products of a size greater than 28 mesh are conveyed by conveyor 24 through a drag tank 18 containing hot water. While in the drag tank 18, the ore products are heated up to a temperature of about 150°-212° F. I prefer to heat the water in the drag tank 18 to that temperature range by means of steam.

The ore product when removed from the drag tank 18 will have a moisture content of about 15°-20%. At this point, the heated product is then subjected to apparatus for removing surface water. Such apparatus is preferably a centrifuge 20. Upon exiting from the centrifuge 20, the ore product has a moisture content of about 10%.

From the centrifuge 20, the ore product passes through an evaporative cooler unit or evaporator 22 which drys the ore product to a moisture content of about 1-2%. The evaporator 22 is preferably a vertical evaporator through which the ore product passes in a downward direction. As the ore product passes through the evaporator 22, it is subjected to low pressure, low volume air moving transversely at ambient temperature. Low volume air will be air at a rate of about 10,000-15,000 cubic feet per ton of coal so as to be less than about 10% of the volume of air used on a thermal dryer as described above. An evaporative cooler unit of this nature removes moisture by evaporation wherein the ore product temperature is reduced during moisture removal as compared with a thermal dryer which increases the temperature of the ore product to remove moisture. Thus, in the method of the present invention, the ore product is never subjected to a temperature greater than the boiling temperature of water at the prevailing barometric pressure.

The evaporator 22 is preferably provided with a volumetric feeder 26 at its discharge end for feeding the cleaned low moisture end product onto a conveyor 28 for transportation to a storage bin, railroad car, etc.

The ore product less than 28 mesh which passed through screen 12 is conveyed to a cleaning unit such as hydrocyclone 14 wherein it is mixed with water and pumped through conduit 30 to a screen 32. Most of the slurry will pass through screen 32 and will be conveyed to the flotation cells 36 where tailings are removed. That portion of the slurry which did not pass through the screen 32 will be conveyed by conduit 34 into which cleaned coal fines are received from the floation cells 36. At this point, the temperature of the coal fines is increased by introducing steam into the conduit 34. The heated fines are then dewatered or dried by use of a conventional coal filter 16. The increased temperature of the coal fines by subjection to steam in conduit 34 facilitates obtaining lower moisture content in the product discharged from the coal filter 16 as compared with filtering the coal fines at ambient temperature. Thus, the present invention takes advantage of the fact that products at an elevated temperature less than the boiling point of water at prevailing barametric pressures contain sensible heat which can be used for evaporative cooling to thereby reduce moisture content.

From the vacuum coal filter 16, the cleaned product is conveyed by a conveyor to a desired location. The conveyor may be a discrete conveyor or may be conveyor 28. It will be noted that various items such as pumps, motors, etc. are not illustrated in the drawings.

Each of the drying steps for the ore product which does not pass through the screen 12 and for the ore product which does not pass through the screen 12 includes subjecting the ore product to a temperature not more than 212° F. and not less than about 150° F.

The components of the system 10 described above will result in a lower initial cost as compared with prior art systems which utilize fluid bed dryers which in turn require high energy scrubbers and the like while at the same time such prior art devices create pollution problems. Further, the components of the system 10 have a lower operating cost and minimize danger of fires and explosions due to the fact that there is no coal dust subjected to high temperatures. The system 10 is more efficient since there is no coal dust subject to being lost up the smokestack or which must be removed by a high energy scrubber.

The content of the raw ore product is usually not capable of being controlled by the processor. Hence, the system 10 contemplates an initial screening step as indicated by rinse screen 12. It will be apparent to those skilled in the art if the ore product has been prescreened, then only one of the flow paths of the system 10 will be utilized depending upon the size of the ore product. While the present disclosure refers to heating the ore product by use of steam, it will be apparent to those skilled in the art that other types of heating devices may be utilized so long as they are compatible with the other concepts of the present invention.

The ore product discharging from the vacuum coal filter 16 has a higher moisture content than the ore product discharging from the evaporator 22. The moisture content from the filter 14 will generally be in the range of 16 to 18% moisture whereas the ore product exiting from the evaporator 22 will have a moisture content of about 1–2%. The two ore products may be combined on a conveyor to provide an ore product having an intermediate moisture content if desired.

The present invention may be embodied in other specific forms without departing from the spirit or essential attributes thereof and, accordingly, reference should be made to the appended claims, rather than to the foregoing specification as indicating the scope of the invention.

I claim:

1. A method of cleaning a raw ore product such as coal comprising the steps of heating the ore product by conveying the ore product through a bath of hot water, then removing surface water from the ore product, and then drying the ore product to the desired moisture content by use of an evaporative cooler, said ore product moving through said evaporative cooler in a downward direction while being contacted by moving air traveling in a transverse direction, said air moving at a rate of substantially between 10,000 and 15,000 cubic feet per ton of ore product.

2. A method in accordance with claim 1 including heating the bath of water by introducing steam thereinto while the ore product is conveyed through the bath, and using a centrifuge to perform said step of removing surface water from the ore product.

3. A method in accordance with claim 1 including the step of rinse screening the ore product before said heating step so that the thusly processed ore product has a size greater than the size of the screen.

4. A method of cleaning raw ore products comprising the steps of subjecting the raw ore products to a rinse screen wherein the ore products are divided into two flow paths based on the size of the screen, heating the large sized ore products by conveying them through a bath of hot water, and then removing surface water from the heated larger sized ore products, then drying the said heated larger sized ore product to the desired moisture content by use of an evaporative cooler, said drying of the larger sized ore products occurring while the ore products are moving downwardly through the evaporative cooler and are being subjected to air at ambient temperature wherein the air capacity is substantially between 10,000 and 15,000 cubic feet per ton of the larger sized ore product, removing tailings from the smaller sized ore products, then heating the smaller sized ore products to a temperature less than about 212° F., and then drying the smaller size ore products to a moisture content greater than the moisture content of the dried larger sized ore products.

5. A method in accordance with claim 4 including mixing the dried ore products to obtain a mixture having an intermediate moisture content.

6. A method in accordance with claim 4 wherein each of said drying steps includes subjecting the ore product to a temperature not more than 212° F. and not less than about 150° F.

7. A method in accordance with claim 4 wherein said ore product is coal, and the larger sized coal pieces being dried to a moisture content of about 1–2%.

* * * * *